US010465929B2

(12) United States Patent
Havia

(10) Patent No.: US 10,465,929 B2
(45) Date of Patent: Nov. 5, 2019

(54) SUPPLY AIR APPARATUS

(71) Applicant: FINLUFT OY, Ylöjärvi (FI)

(72) Inventor: Kyösti Havia, Lakiala (FI)

(73) Assignee: FINLUFT OY, Ylojarvi (FI)

( * ) Notice: Subject to any disclaimer, the term of this patent is extended or adjusted under 35 U.S.C. 154(b) by 499 days.

(21) Appl. No.: 15/112,043

(22) PCT Filed: Jul. 29, 2014

(86) PCT No.: PCT/FI2014/050599
§ 371 (c)(1),
(2) Date: Jul. 15, 2016

(87) PCT Pub. No.: WO2015/114197
PCT Pub. Date: Aug. 6, 2015

(65) Prior Publication Data

US 2017/0122608 A1 May 4, 2017

(30) Foreign Application Priority Data

Jan. 30, 2014 (FI) ..... 20140023

(51) Int. Cl.
*F24F 7/013* (2006.01)
*E06B 7/10* (2006.01)
(Continued)

(52) U.S. Cl.
CPC ..... *F24F 7/013* (2013.01); *E06B 7/02* (2013.01); *E06B 7/10* (2013.01); *E06B 2007/023* (2013.01); *F24F 7/007* (2013.01)

(58) Field of Classification Search
CPC .. F24F 7/013; F24F 7/007; E06B 7/02; E06B 7/10; E06B 2007/023
(Continued)

(56) References Cited

U.S. PATENT DOCUMENTS 2,225,070 A * 12/1940 Meyerhoefer ..... F24F 7/06 415/100
2,313,676 A 3/1943 Shaver
(Continued)

FOREIGN PATENT DOCUMENTS

AT 389347 B 4/1989
CN 203083022 U 7/2013
(Continued)

OTHER PUBLICATIONS

Supplementary Search Report issued in European Patent Application No. 14880781.1, dated Aug. 16, 2017.
(Continued)

*Primary Examiner* — Gregory L Huson
*Assistant Examiner* — Dana K Tighe
(74) *Attorney, Agent, or Firm* — Venable LLP; Jeffri A. Kaminiski

(57) ABSTRACT

A supply air apparatus for producing outdoor air into an indoor space assisted by an auxiliary powered blower by simultaneously mixing the outdoor air with air from the indoor space. In connection with an outdoor air flow way in a structure in a building between the indoor space and outside air, a flow space and flow connections for outdoor and indoor air for mixing with each other, the blower and a blow flow arrangement for leading a mixed flow of air into the indoor space in the building. In connection with a supply air device in an outer wall of the building, an air distribution device including: a frame; a flow space in the frame; an inflow outdoor and indoor air that joins with the flow space and opens into an internal space in the building; the blower; and a blow flow leading the mixed air into the indoor space.

5 Claims, 5 Drawing Sheets

(51) Int. Cl.
*E06B 7/02* (2006.01)
*F24F 7/007* (2006.01)

(58) Field of Classification Search
USPC ..... 454/200, 205, 234
See application file for complete search history.

(56) References Cited

U.S. PATENT DOCUMENTS

| | | | | |
|---|---|---|---|---|
| 2,352,821 | A * | 7/1944 | Conboie | F24F 7/06 454/234 |
| 3,363,531 | A * | 1/1968 | Kohlmeyer | A01K 1/0052 454/234 |
| 3,367,258 | A * | 2/1968 | Erfeling | A01K 1/0047 454/234 |
| 3,831,669 | A * | 8/1974 | Menne | F24F 1/00 165/122 |
| 6,168,517 | B1 | 1/2001 | Cook | |
| 6,241,600 | B1 * | 6/2001 | Uehara | F24F 7/013 454/235 |

FOREIGN PATENT DOCUMENTS

| | | | |
|---|---|---|---|
| DE | 20106814 | U1 | 6/2001 |
| GB | 2260807 | A | 4/1993 |
| GB | 2424059 | A | 9/2006 |
| JP | 2000274784 | A | 10/2000 |
| KR | 20120016901 | A | 2/2012 |
| WO | 2011001957 | A1 | 1/2011 |
| WO | 2011132999 | A2 | 10/2011 |

OTHER PUBLICATIONS

PCT/ISA/210—International Search Report—dated Apr. 29, 2015 (Issued in Application No. PCT/FI2014/050599).

PCT/ISA/237—Written Opinion of the International Searching Authority—dated Apr. 29, 2015 (Issued in Application No. PCT/FI2014/050599).

PCT/IPEA/409—International Preliminary Report on Patentability—dated Jan. 28, 2016 (Issued in Application No. PCT/FI2014/050599).

* cited by examiner

SUPPLY AIR APPARATUS

CROSS-REFERENCE TO RELATED APPLICATIONS

The application claims priority to Finnish patent application 20140023 filed 30 Jan. 2014 and is the national phase under 35 U.S.C. § 371 of PCT/FI2014/050599 filed 29 Jul. 2014.

FIELD OF THE INVENTION

The invention relates to a supply air apparatus, which supply air apparatus is meant especially for producing outdoor air into an indoor space assisted by an auxiliary powered, such as electrical, blower arrangement by simultaneously mixing the outdoor air to be brought into the indoor space with air from the indoor space.

BACKGROUND OF THE INVENTION

Especially in underpressurized air conditioning systems the ventilation is based on underpressurizing, my means of which air is sucked in. Unless there are controlled pathways for replacement air, air tends to drift inside a building through all possible routes. In order to control the replacement air flows, there are in practice first of all passive that is without a blower naturally operating replacement air valves that have typically both mechanical adjustment arrangements for adjusting the amount of replacement air and filter arrangements in order to filter replacement air being fed indoors and to dampen the noise coming from outside. On the other hand, there are in practice also active that is blower operated replacement air valves and furthermore also replacement air valves provided with heating arrangements, with which the production of replacement air may be adjusted e.g. with adjustment mechanisms or by adjusting the speed of rotation of the blower.

One problem in producing replacement air is the movement of the cold outdoor air, being fed indoors, which causes a so called feeling of draft. The optimal functioning of an air replacement valve is based on a flow of warm indoor air passing upwards, which lifts the cold replacement air to go upwards along the inner surface of the ceiling. When such a flow slows down it gets thus warmer by getting mixed with the warm air close to the ceiling, causing thus not any feeling of draft to be noticed in the living space of the apartment. This is why the replacement air valves are usually installed above radiators.

Nowadays energy efficiency of buildings has been improved and radiators have been exchanged e.g. into low-heat radiators or the heating has been switched to underfloor heating, due to which the air flow passing upwards along the walls has diminished and is thus not able to eliminate the feeling of draft on its own. On the other hand, in traditional construction technique the flow of replacement air often takes place in a decentralized manner e.g. through window gaps, whereby the speed of replacement air flow is relatively slow. In these types of cases, e.g. in connection with window renovation according to today's practice, windows have either been tightened and the apartments have been provided with separate replacement air valves or the original windows have been replaced with new windows having replacement air valves, after which the flow of replacement air into the apartment takes place at a higher speed in a spotlike manner. Actually the speed of replacement air flow rises even more, because in traditional renovation usually all windows are tightened and only some are provided with replacement air valves. Due to the feeling of draft, the replacement air valves are often closed during a heating season, which disrupts the ventilation. However, from the point of view of the functioning of the ventilation, it is important that feeding of replacement air occurs as planned regardless of outside temperature.

Furthermore, especially when placing the window valves in spaces that have e.g. curtain boxes, the natural flow of replacement air is blocked, which is why it may flow down e.g. along the window surface causing both a feeling of draft and the moistening/frosting of the inner surface of the window, which also often leads to the closure of the replacement air valves. E.g. in an apartment building, when one or more residents close their replacement air valves and the constant-speed exhaust air volume does not diminish, a higher under-pressure is caused in other apartments and thus also a stronger feeling of draft, which brings about a need for other residents to also close the replacement air valves.

Preventing the free and controlled feed flow of replacement air causes a distortion for the pathways of replacement air in the buildings, in which case air enters through structures, hallways and even through the sewer system. This causes unclean indoor air and strains the structures. Symptoms of these types of problems are e.g. smells in the apartments that are drifted from e.g. neighbours, the hallway, the sewer etc. and sewer clogs. Thus, e.g. in ground floor buildings, such as in terraced houses or single-family houses and in the lower floors in apartment buildings, but the same way also in higher floors through e.g. elevator shafts and other vertical shafts, the closure of the replacement air valves causes the replacement air to pass through the ground and the structures. In this case, e.g. natural gases, such as e.g. radon, are basically being sucked into the apartment, which as such is a significant health risk, controlling of which requires measuring actions and based on which, when the threshold values are exceeded, renovating actions, such as assembling a radon well etc.

Especially in order to control the feeding of outdoor air to be fed into a building's indoor space, a supply air apparatus is previously known from e.g. patent publication GB 2260807, which supply air apparatus comprises a flow space with flow connections in connection with an outdoor air flow way in between an indoor space of a building and outdoor air in order to mix outdoor air and indoor air with each other, a blower arrangement, such as a blower functioning on axial principle, and a blow flow arrangement in order to lead the mixed air inside the building.

With a solution described above it is possible to carry out the feeding of outdoor air into an indoor space by mixing indoor air, being produced from an apartment by an indoor air suction blower, with outdoor air, being fed into a suction channel by a blower, by feeding the mixed air to pass near the ceiling of the room guided by a lower guide. In this solution, the volume flow of the mixed air flow being blown into the apartment is to be regulated by adjusting the functioning of the blower, whereby the air being blown into the room is also, if needed, heated by auxiliary heaters existing near the ceiling. In addition, the air blower that circulates the indoor air is being guided according to outdoor air temperature in a way that its capacity is highest when outdoor air temperature is low and lowest when outdoor air temperature is high.

A disadvantage of the above mentioned solution is the large amount of apparatuses that is the blowers for both outside and inside air used therein, in addition to which the principle according to the solution may not be used as such in connection with existing replacement air valves that usually have already at least a mechanical adjustment arrangement in order to adjust the amount of outdoor air to be brought through the replacement air valve into the apartment.

SUMMARY OF THE INVENTION

The supply air apparatus according to the present invention is aimed to achieve a decisive improvement in the problems described above and thus to raise substantially the level of prior art.

As the most important advantages of the supply air apparatus according to the invention may be mentioned simplicity and efficiency of utilization and constructions related thereto, which, through eliminating the feeling of draft, enable the functioning of replacement air valves in apartments to be made more efficient by lowering the need for underpressurizing by helping the passage of replacement air. Thus, there is no need for closing the replacement air valves as the ventilation of the indoor air in the apartment takes place optimally thanks to the air from the replacement air valves occurring as an overhead flow in the living space of the apartment. By virtue of the invention, the "climate" of the apartment improves significantly as the feeding of the replacing outdoor air occurs in a way that the replacement air being brought into the apartment heats up at the ceiling of the apartment before drifting downward, which eliminates the feeling of draft from getting born.

As an advantageous embodiment, in the blower arrangement of the supply air apparatus according to the invention it is possible to utilize an extra-low voltage, typically e.g. at 5-24 V voltage, operated device blower, the power supply and control of which may be carried out a lot simpler than on mains current operated devices and in a more safe way with respect to both its assembly and use.

The supply air apparatus according to the invention may furthermore advantageously be carried out e.g. by installing the air distribution device according to the invention above an existing replacement air valve in a wall so that the inflow arrangement of the air distribution device opening into an indoor space of a building "sucks" both outdoor air being led through the replacement air valve and warm indoor air, and forwards the mixed air flow further with one or more parallel device blowers to take place essentially close to the ceiling through an overhead guide in the air distribution device without the risk of drifting thereof e.g. down along a window surface.

The supply air apparatus according to the invention may as an alternative solution be carried out also by an air distribution device, being in an integrated manner in connection with a window so that it is placed in the space between overlapping window structures, wherein its outdoor air production is advantageously arranged by outdoor air, being led in e.g. through ventilation holes in the outer window structure of the window. The controlling of the supply air apparatus according to the invention may furthermore be carried out the simplest way by controlling the functioning of its blower arrangement that is its speed of rotation electronically e.g. wirelessly.

With the supply air apparatus according to the invention it is thus possible to both improve the ventilation of existing buildings by improving the functioning of existing replacement air valves and make possible proper production of replacement air from the very beginning in the new building construction without the need for the residents to adjust the replacement air valves due to the feeling of draft. In addition, in the renovation construction it is possible to replace windows in poor condition with tightened ones, provided with replacement air valves for producing desired replacement air. Thanks to a properly functioning ventilation, in addition to the feeling of draft, also those very common problems due to mold and other the like problems caused by badly functioning ventilation may be avoided.

BRIEF DESCRIPTION OF THE DRAWINGS

In the following description the invention is being described in detail with reference to the enclosed drawings, in which in FIGS. 1*a*-1*e* are shown a front view, a side view, a cross-sectional side view, an overhead view and diagonally from above shown perspective view of an advantageous air distribution device according to a first alternative of the supply air apparatus according to the invention, in FIGS. 2*a*-2*d* are shown respective views as in FIGS. 1*a*, 1*b*, 1*d* and 1*e* of an alternative implementation with respect to the air distribution device shown in FIGS. 1*a*-1*e*, in FIG. 3 is shown a side view regarding the placement of an air distribution device, implemented according to the first alternative, above a replacement air valve in connection with a curtain box, in FIG. 4 is shown an alternative implementation with respect to FIG. 3, in which the air distribution device according to the first alternative is placed in the wall above a replacement air valve close to the ceiling, and in FIGS. 5*a* and 5*b* are shown as an exemplary manner first of all a side view of an implementation of the air distribution device according to a second alternative of the supply air apparatus and secondly an enlarged detail from the placement point of the air distribution device.

DETAILED DESCRIPTION OF EMBODIMENTS OF THE INVENTION

The invention relates to a supply air apparatus, which is meant for producing outdoor air into an indoor space assisted by an auxiliary powered, advantageously electrical, blower arrangement 1 by simultaneously mixing the outdoor air u to be brought into the indoor space with air from the indoor space s. The supply air apparatus comprises in connection with an outdoor air flow way that exists in a structure W in a building between the indoor space and outdoor air a flow space V along with its flow connections for outdoor air and indoor air for mixing the above with each other, the blower arrangement 1, such as one or more, advantageously on axial principle operated, blowers, and a blow flow arrangement 2 for leading a mixed flow of air us into the indoor space in the building. The supply air apparatus comprises in connection with a supply air device X, such as a replacement air valve or like, in an outer wall of the building a built-in air distribution device Y, which comprises: a box-structured frame R; an internal flow space V in the frame; an inflow arrangement SV of outdoor and indoor air that joins with the flow space and opens into an internal space ST in the building; the blower arrangement 1, such as one or several parallelly coupled device blowers or like; and the blow flow arrangement 2 that leads the mixed air us into the indoor space.

Figure 1C:
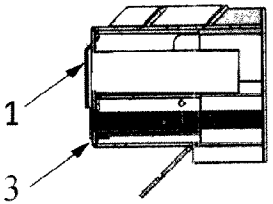
Figure 1B:
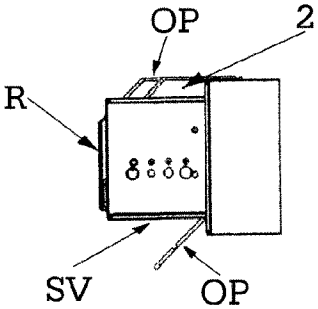
Figure 1A:
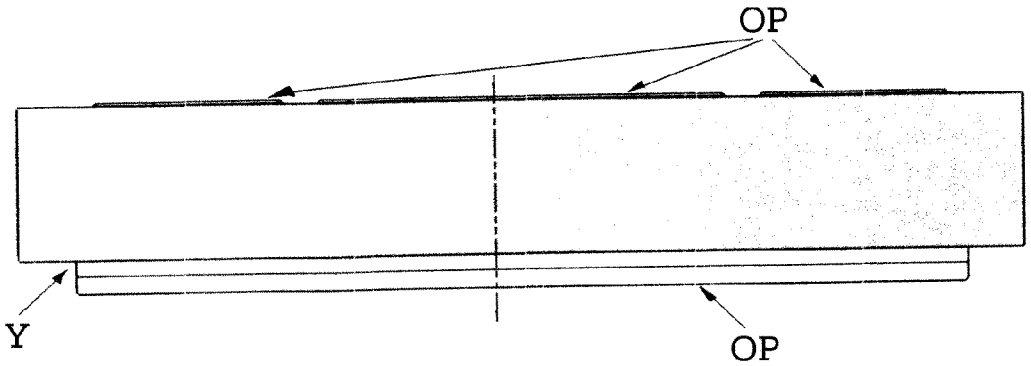
Figure 1D:
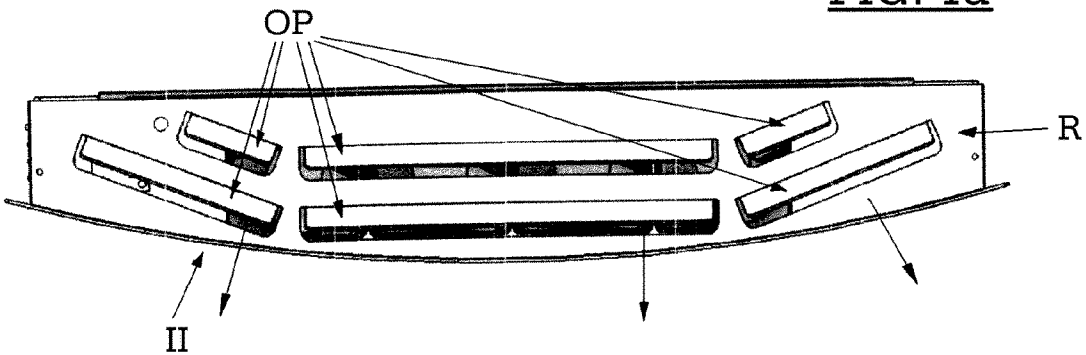
Figure 1E:
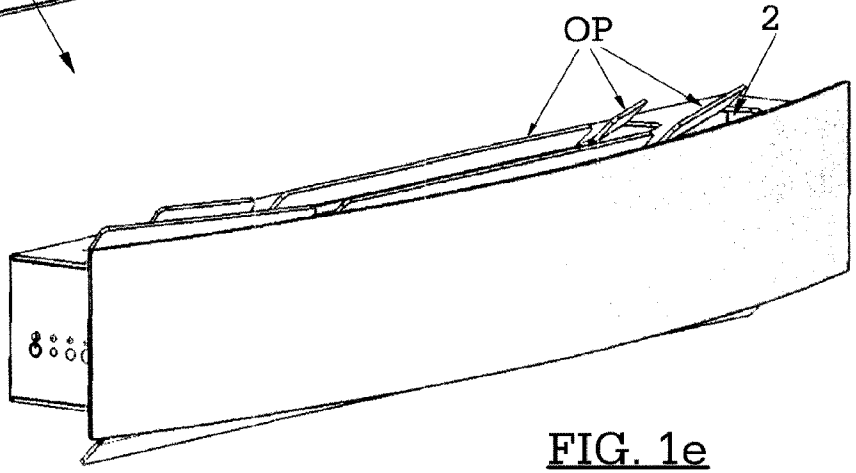
Figure 2A:
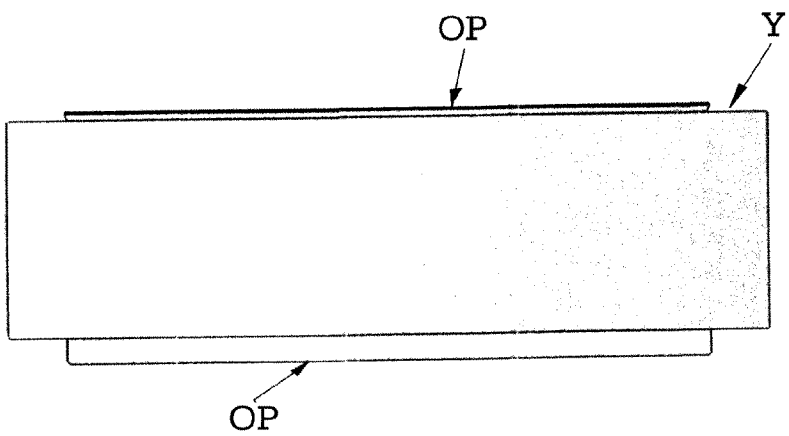
Figure 2B:
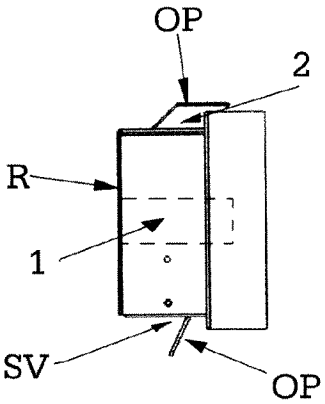
Figure 2C:
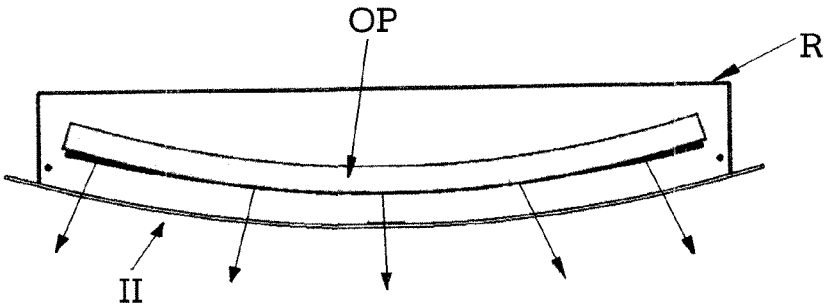
Figure 2D:
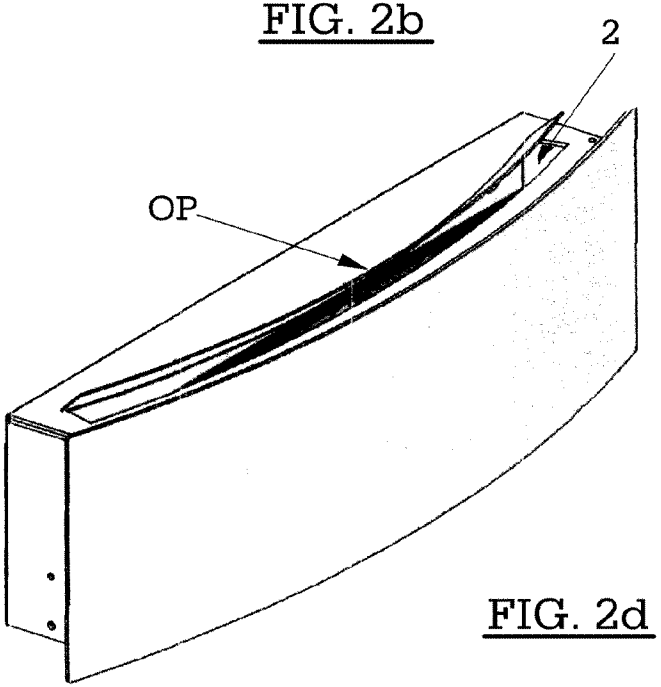
Figure 3:
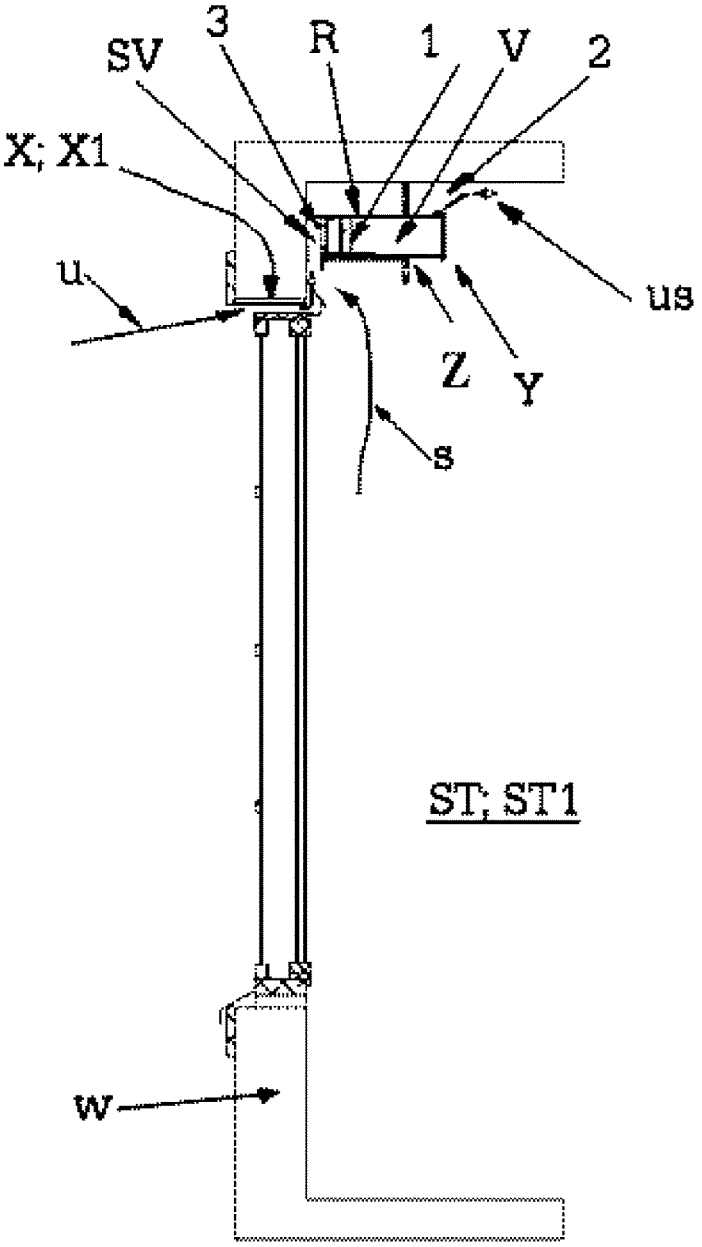
Figure 4:
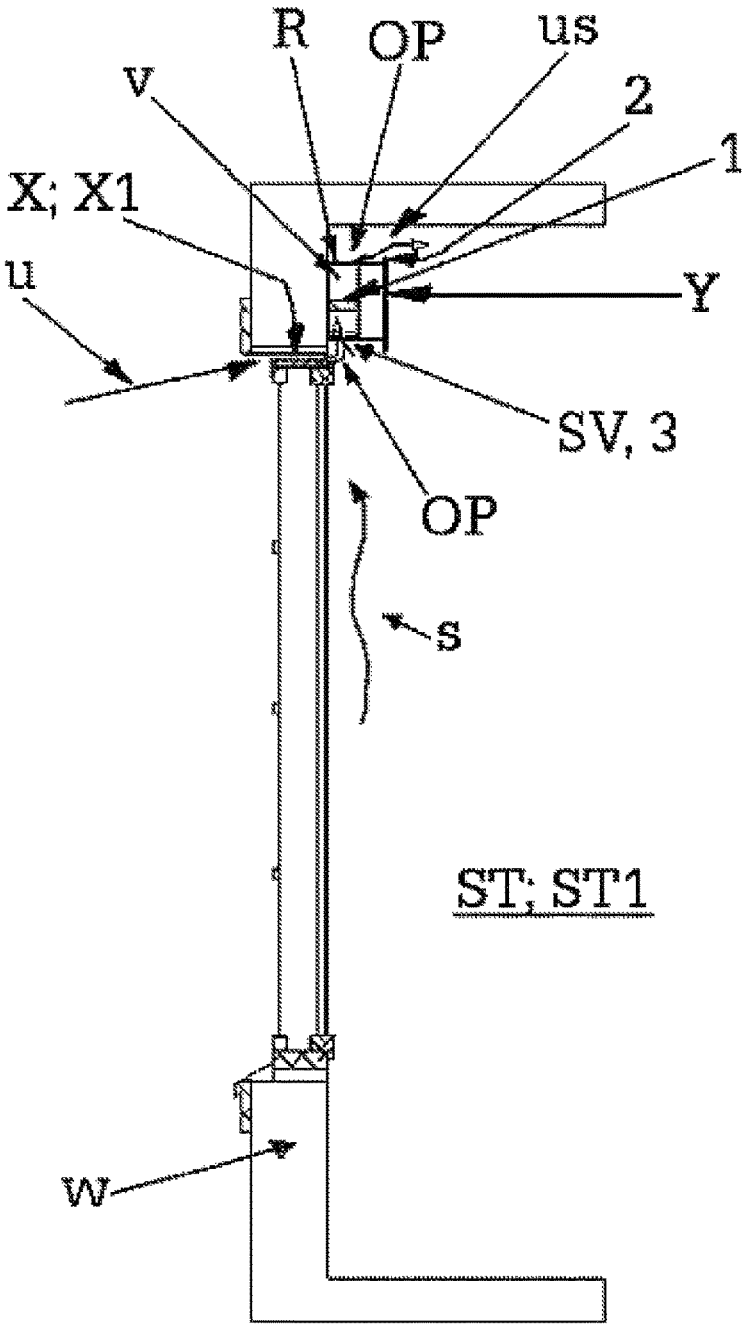

As an advantageous embodiment of a first alternative of the air supply apparatus according to the invention as shown e.g. in FIGS. 1*a*-1*e* or 2*a*-2*d*, the air distribution device Y is arranged on the principle as shown e.g. in FIGS. 3 and 4 in the indoor space ST1 in the building on an inner surface of an outer wall, such as in a wall or a ceiling, above a supply air device X, such as replacement air valve X1 in a window or a like, existing in an outer wall W of the building.

Figure 5A:
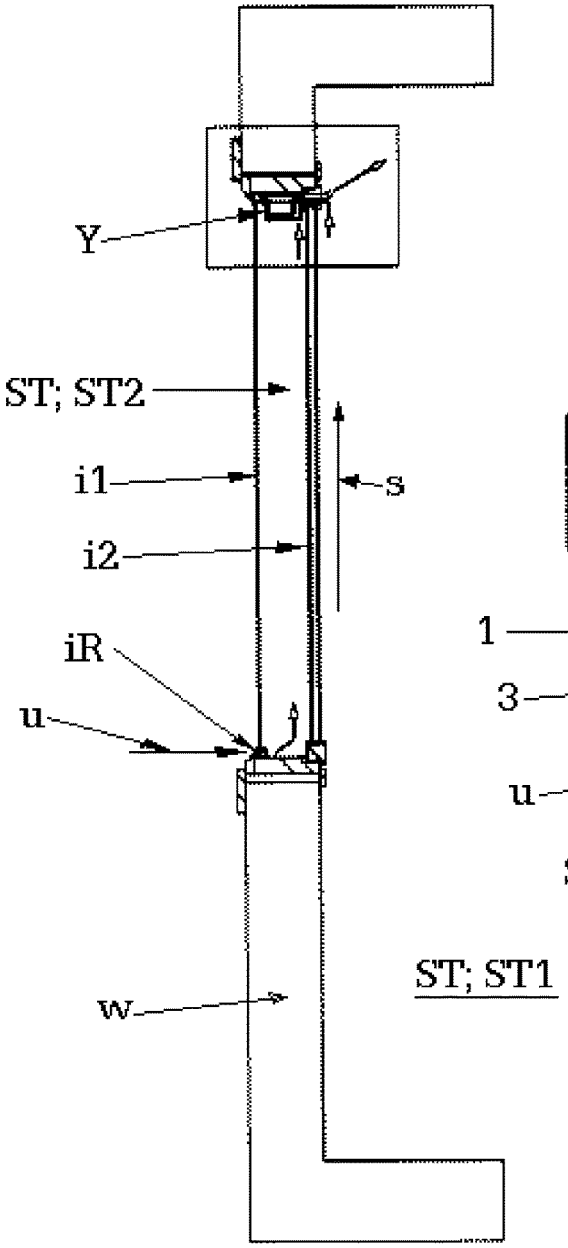
Figure 5B:
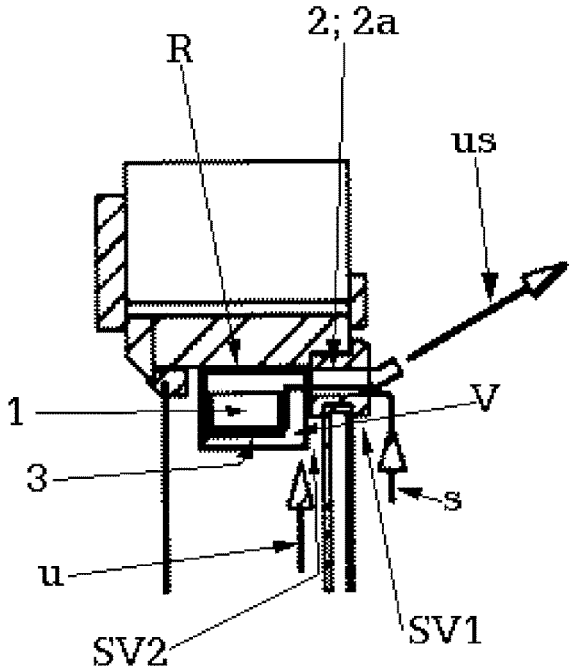

As an advantageous embodiment of the second alternative of the supply air apparatus according to the invention, the air distribution device Y is arranged on the principle as shown e.g. in FIGS. 5*a*, 5*b* in a space ST2 between window structures i1, i2 in a window existing in an outer wall W of the building.

Thus, as a furthermore advantageous embodiment of the supply air apparatus according to the invention, feeding of the outdoor air into the air distribution device Y is arranged by outdoor air u that is led into the space ST2 between the window structures i1, i2 in the window through flow ways iR existing in connection with the outer window structure it of the window, such as through ventilation openings at a lower edge thereof.

In this context, as a further advantageous embodiment of the supply air apparatus according to the invention, the inflow arrangement SV1 of indoor air comprises a flow way leading from the indoor space ST to the frame R for leading of indoor air of the building to the flow space R, V in the frame and the inflow arrangement SV2 of outdoor air comprising a flow way that is open from the frame R to the space ST2 between the window structures.

In this context, as a further advantageous embodiment, the blow flow arrangement 2 comprises a flow way 2*a* that leads from the frame R into the indoor space ST in the building for leading the mixed air us into the indoor space ST1.

As a further advantageous embodiment of the first alternative of the supply air apparatus according to the invention, the inflow arrangement SV for outdoor and indoor air and/or the blow flow arrangement 2 of the air distribution device Y is/are arranged on the principle as shown in FIGS. 1*d*, 1*e* and 2*c*, 2*d* when viewed in a horizontal plane to be directed in more than one direction. Differing from what is shown in FIGS. 1*a*-1*e*, in the implementation shown in FIGS. 2*a*-2*d*, there is in an arched manner uniformly continuing hole for the inflow of indoor and outdoor air and an outflow hole 2 for mixed air.

As a further advantageous embodiment of the supply air apparatus according to the first alternative, an end II on the side of the output end of the air distribution device's frame R is arranged e.g. in a continuously arched manner convex towards the indoor space ST1 in the building.

Furthermore as an advantageous embodiment of the supply air apparatus according to the invention with reference to FIGS. 1*a*-1*e* and 2*a*-2*d*, the inflow arrangement SV and/or the blow flow arrangement 2 of the air distribution device comprise/comprises in one or more parts, when viewed from the side, in an inclined position from the frame R outwards directed guide surfaces OP for guiding the air flows in a direction of height.

As it is possible to implement the embodiment shown in FIG. 4 according to e.g. embodiments shown in FIGS. 1 and 2, the air distribution device Y in FIG. 3 differs partly from the type of embodiment shown in FIGS. 1 and 2, wherein the length of the body of the air distribution device is arranged adjustable advantageously e.g. on telescope-principle in order to fit the device in different kinds of widow box structures Z.

As a further advantageous embodiment of the supply air apparatus according to the invention, the air distribution device comprises with cleanable and/or replaceable filters implemented filtering means 3 for filtering of outdoor air u, indoor air s and/or mixed air us.

As a further advantageous embodiment, in the supply air apparatus according to the invention it is possible to utilize an extra-low voltage, typically e.g. at 5-24 V voltage, operated device blower, the power supply and control of which may be carried out in a significantly simpler and safer manner than on mains current operated devices.

Adjusting the capacity of the device blower may be carried out in addition to or alternative to stepless voltage adjustment also by using e.g. parallel device blowers with on/off-principle, which means that maximal production is produced by using all device blowers and minimum production by using just one.

As an advantageous actuator in practice may be mentioned a product, being marketed with the type name NF-R8, which, thanks to the noise damping technique used therein, makes possible an air distribution device that has a very silent operating sound.

It is clear that the invention is not limited to the embodiments presented or described above, but instead it can be modified significantly within the basic idea depending on the installation site at any given time. It is thus clear that the shape of the replacement air valve may, differing from the elongated implementation as shown in the figures, also be more spotlike that is e.g. round, square shaped etc. by its cross-section. In this context, it is furthermore worth noticing that thanks to the invention, existing replacement air valves need not to be fixed, but instead, the possible filters and adjustment arrangements therein may still be utilized according to the original purpose of use thereof. The technique of the air distribution device in the supply air apparatus according to the invention may alike be varied by using e.g. a mains current or accumulator operated blower arrangement, the adjustment of the functionings of which may also be carried out with traditional wired adjustment arrangements or e.g. with cloud server principle from outside the apartment through a server e.g. in order to control the ventilation of the apartment when the apartment in empty in the winter or in other kinds of corresponding situations.

The invention claimed is:

1. A supply air apparatus for flowing outdoor air into an indoor space of a building containing indoor air assisted by an auxiliary powered blower arrangement by mixing the outdoor air to be brought into the indoor space with the indoor air from the indoor space, wherein the supply air apparatus is connected to an outdoor air flow way provided in a structure of the building between the indoor space and an outdoor air flow space using air flow connections for flowing the outdoor air into the indoor space containing the indoor air and mixing the outdoor air and the indoor air with each other, the supply air apparatus comprising:

the auxiliary powered blower arrangement and a blow flow arrangement for directing a flow of mixed air into the indoor space, and an air distribution device in connection with a replacement air valve provided in connection with a window structure wherein the air distribution device is configured and arranged to provide an air flow passing upwards along an outer wall of the building, and wherein the air distribution device is arranged in the indoor space in the building on an inner surface of the outer wall or a ceiling above the replacement air valve, the air distribution device comprising in a built-in manner:

a box-structured frame;

an internal flow space in the frame;

an inflow arrangement of the outdoor air and the indoor air that joins with the internal flow space in the frame and opens into an internal space in the building;

the auxiliary powered blower arrangement; and the blow flow arrangement that directs the flow of mixed air into the indoor space.

2. The supply air apparatus according to claim 1, wherein at least one of the inflow arrangement for the outdoor air and the indoor air or the blow flow arrangement of the air distribution device arranged on an inner surface of the outer wall is arranged when viewed in a horizontal plane to be directed in more than one direction.

3. The supply air apparatus according to claim 2, wherein an end on a side of an output end of the frame of the air distribution device is arranged convex towards the indoor space in the building.

4. The supply air apparatus according to claim 2, wherein at least one of the inflow arrangement or the blow flow arrangement of the air distribution device comprises at least one part, when viewed from the side in an inclined position from the frame outwards directed guide surfaces for guiding the air flows in a direction of height.

5. The supply air apparatus according to claim 1, wherein the air distribution device comprises with at least one of cleanable or replaceable filters implemented filtering for filtering of the outdoor air, the indoor air and/or the flow of mixed air.

* * * * *